US010527034B2

(12) United States Patent
Gao et al.

(10) Patent No.: US 10,527,034 B2
(45) Date of Patent: Jan. 7, 2020

(54) DIGITIZED AUTOMATIC CONTROL METHOD FOR OIL-PUMPING AND DIGITIZED BALANCE-SHIFTING PUMPJACK

(71) Applicant: XINJIANG UYGUR AUTONOMOUS REGION NO 3 MACHINE TOOL WORKS, Urumqi (CN)

(72) Inventors: Changle Gao, Urumqi (CN); Shenghong Zheng, Urumqi (CN); Shujian Ma, Urumqi (CN); Ninghui Li, Urumqi (CN); Shengcun Yu, Urumqi (CN); Kangjun Wang, Urumqi (CN); Xiaoke Ji, Urumqi (CN); Quan Lin, Urumqi (CN); Jiaqiang Zhu, Urumqi (CN); Jing Zhang, Urumqi (CN); Hongyu Dong, Urumqi (CN); Chunwang Sun, Urumqi (CN)

(73) Assignee: XINJIANG UYGUR AUTONOMOUS REGION NO 3 MACHINE TOOL WORKS, Xinjiang (CN)

( * ) Notice: Subject to any disclaimer, the term of this patent is extended or adjusted under 35 U.S.C. 154(b) by 194 days.

(21) Appl. No.: 15/638,338

(22) Filed: Jun. 29, 2017

(65) Prior Publication Data

US 2017/0298923 A1 Oct. 19, 2017

Related U.S. Application Data

(63) Continuation of application No. PCT/CN2015/100034, filed on Dec. 31, 2015.

(30) Foreign Application Priority Data

Dec. 31, 2014 (CN) ..... 2014 1 0852566

(51) Int. Cl.
*F04B 47/02* (2006.01)
*E21B 43/12* (2006.01)
*E21B 44/02* (2006.01)

(52) U.S. Cl.
CPC ..... *F04B 47/022* (2013.01); *E21B 43/121* (2013.01); *E21B 44/02* (2013.01); *E21B 2043/125* (2013.01); *F04B 2203/0201* (2013.01)

(58) Field of Classification Search
CPC ..... E21B 44/02; E21B 44/00; E21B 43/121; E21B 43/127; E21B 43/125; F04B 49/065; F04B 47/022; F04B 47/00; F04B 47/02
See application file for complete search history.

(56) References Cited

U.S. PATENT DOCUMENTS 2,113,281 A * 4/1938 Porter ..... F04B 47/02 74/103
3,016,797 A * 1/1962 Liautaud ..... G02C 5/126 2/446

(Continued)

FOREIGN PATENT DOCUMENTS

CN 201277016 Y 7/2009
CN 101725332 A 6/2010

(Continued)

OTHER PUBLICATIONS

International Search Report of corresponding International PCT Application No. PCT/CN2015/100034, dated Apr. 27, 2016.

*Primary Examiner* — Charles G Freay
(74) *Attorney, Agent, or Firm* — J.C. Patents

(57) ABSTRACT

Disclosed are a digitized automatic control method for oil-pumping and a digitized balance-shifting pumpjack, said pumpjack comprising a main motor (15), a decelerator (8), a crank (9), a connecting rod (6), a walking walking beam (Continued)

(3), a balance arm (7), a derrick (5), a horsehead (2), a substructure (12), brake device (13), a beam hanger (1), a load sensor (17), a stroke process measurer, a safety stop device, and a digitized control box (14). A movable counterweight box (28) moves leftward and rightward on the balance arm (7), automatically balancing load at the suspension center in various operating conditions, and pumpjack's frequency of stroke is automatically adjusted according to variations in pump fullness. Features include safety and reliability, convenience of operation, enhanced oil well production, balance rates, energy conservation and consumption reduction.

10 Claims, 9 Drawing Sheets

(56) References Cited

U.S. PATENT DOCUMENTS 3,222,940 A * 12/1965 Chastain ..... F16F 15/261 74/37
4,145,161 A * 3/1979 Skinner ..... E21B 43/127 417/22
4,194,393 A * 3/1980 Boley ..... E21B 43/127 346/33 R
4,660,426 A * 4/1987 Mosley ..... F04B 47/14 74/41
5,251,696 A * 10/1993 Boone ..... E21B 43/127 166/250.15
5,281,100 A * 1/1994 Diederich ..... E21B 43/127 417/18
5,441,108 A 8/1995 Jenkins et al. ..... 166/53
6,450,050 B1 * 9/2002 Luo ..... F04B 47/028 74/41
8,083,627 B2 * 12/2011 Kito ..... F16D 25/0638 192/106 F
9,157,437 B2 * 10/2015 Yahaba ..... F04C 18/00
2013/0089439 A1 * 4/2013 Becker ..... E21B 43/127 417/53

FOREIGN PATENT DOCUMENTS

CN 101818632 A 9/2010
CN 102094597 A 6/2011
CN 102434128 A 5/2012
CN 103670341 A 3/2014
CN 203531856 U 4/2014
CN 203531863 U 4/2014
CN 203535446 U 4/2014
CN 104060968 A 9/2014
CN 203939489 U 11/2014
CN 104563970 A 4/2015
CN 104612631 A 5/2015
CN 204402438 U 6/2015
CN 204402439 U 6/2015
CN 204402440 U 6/2015
CN 104775792 A 7/2015
GB 2474579 A 4/2011

* cited by examiner

DIGITIZED AUTOMATIC CONTROL METHOD FOR OIL-PUMPING AND DIGITIZED BALANCE-SHIFTING PUMPJACK

CROSS-REFERENCE TO RELATED APPLICATIONS

This application is a continuation of International Application No. PCT/CN2015/100034, filed on Dec. 31, 2015, which claims priority to Chinese Patent Application No. 201410852566.7, filed on Dec. 31, 2014. The disclosures of the aforementioned applications are hereby incorporated by reference in their entireties.

TECHNICAL FIELD

The present invention relates to the technical field of walking beam pumpjack, and particularly to a digitized automatic control method for oil-pumping and a digitized balance-shifting pumpjack.

BACKGROUND

The existing walking beam pumpjacks are mainly as follows: conventional walking beam pumpjack, pre-posed walking beam pumpjack, bias walking beam pumpjack and unusually shaped walking beam pumpjack, etc, and at present, the walking beam pumpjack generally includes a horsehead, a walking beam, a derrick, a connecting rod, a substructure, a crank, a balance device, a decelerator, a brake, a motor and a beam hanger. With the derrick, decelerator, brake, motor, control cabinet, etc. fixedly mounted on the substructure, the walking beam hinged on the derrick, the crank fixedly mounted on the output shaft of the decelerator, one end of the connecting rod hinged on the crank, and the other end of the connecting rod hinged on the walking beam, a four-connecting-rod-structure is formed. The horsehead is mounted on the front end of the walking beam, and the beam hanger is mounted on the horsehead; the balance device is mounted on the crank, or/and the balance device is mounted on the walking beam, so that the balance is adjusted by varying the balance torque by adding and subtracting the mass of the counterweight manually, or/and by varying the position of the counterweight; however, the existing walking beam pumpjack has significant deficiencies in terms of two aspects: first, the balance cannot be adjusted automatically, and it needs to be adjusted in time based on the variation in oil well load. If the balance rate is very low, the operation state of the pumpjack will deteriorate and the power consumption thereof will increase; second: the frequency of stroke cannot be adjusted automatically, which causes the oil-pumping capacity of the pumpjack to be constantly higher or lower than the oil production. If the pumpjack's frequency of stroke is too high, the oil-pumping capacity will be higher than the oil production of oil well, which in turn causes an empty pumping and liquid impact, damages the pumpjack, the oil-pumping rod, the pump, reduces the service life, and wastes electric energy; if the pumpjack's frequency of stroke is too low, the oil-pumping capacity will be lower than the oil production of oil well, which in turn reduces oil well production.

SUMMARY

The present invention provides a digitized automatic control method for oil-pumping and a digitized balance-shifting pumpjack. The disclosed overcomes the drawbacks of the above-mentioned prior art and can effectively solve the problem that the existing walking beam pumpjack cannot automatically adjust the balance and the frequency of stroke, which causes a low balance rate, a mismatch between the stroke and the oil production of oil well, and further an easily occurred failure of the pumpjack, difficulty for the oil well in achieving the maximum capacity and a high manufacturing cost.

The first technical solution of the present invention is realized by a digitized automatic control method for oil-pumping including a digitized balance-shifting pumpjack. The digitized balance-shifting pumpjack includes a main motor, a walking beam, a balance arm, a crank and a beam hanger. The balance arm is fixedly mounted on a left end of the walking beam, and a movable counterweight box and a driving device enabling the movable counterweight box to move leftward and rightward are respectively mounted on the balance arm. A stroke process measurer is mounted on the digitized balance-shifting pumpjack, and a load sensor is fixedly mounted on the beam hanger; the digitized balance-shifting pumpjack further includes a central processor and a three-phase electric parameter collecting device which is mounted on a power supply input end; and the method is performed in the following steps:

step 1: transmitting, respectively, data collected by a stroke process measurer and a three-phase electric parameter collecting device to a central processor; processing, by the central processor, a collected current value during each stroke process to find a maximum current value $I_{down\ max}$ in a down stroke and a maximum current value $I_{up\ max}$ in an up stroke; calculating, by the central processor, a current balance degree value H1, i.e., $H1=I_{down\ max}/I_{up\ max}$;

step 2: comparing N current balance degree values, H1 s, which are obtained according to set stroke times of N, with a set value for a lower limit of current balance degree being A11, a set value for a lower limit of current balance degree adjustment target being A12, a set value for an upper limit of current balance degree being B11, and a set value for an upper limit of current balance degree adjustment target being B12;

performing no adjustment on the movable counterweight box as long as there is one value H1 in line with A11≤H1≤B11 during the N strokes, which is a current balance state; moving the movable counterweight box leftward by a driving device after the N strokes, if all the N H1 s are smaller than A11, which is a current underbalance state so that the current balance degree H1 reaches A12≤H1≤B12; moving the movable counterweight box rightward by the driving device after the N strokes, if all the N H1 s are greater than B11, which is a current overbalance state so that the current balance degree H1 reaches A12≤H1≤B12.

A further optimization or/and improvement to the above-mentioned first technical solution of the present invention is/are provided as follows:

in the above, during each stroke, calculating, by the central processor, based on the collected current value and voltage value to obtain an average power value $P_{down}$ in the down stroke and an average power value $P_{up}$ in the up stroke, and comparing them. Taking the larger value as a denominator, i.e., $P_{large}$, and the smaller value as a numerator, i.e., $P_{small}$, and then calculating a power balance degree value H2, i.e., $H2=P_{small}/P_{large}$; comparing N power balance degree values, H2s, which are obtained according to the set stroke times N; the set value for a lower limit of power balance degree is A21, and the set value for a lower limit of power balance degree adjustment target is A22;

performing no adjustment on the movable counterweight box during the N strokes, as long as there is one value H2 in line with A21≤H2, which is a power balance state;

moving the movable counterweight box leftward by the driving device after the N strokes, if all the N H2s are smaller than A21 and $P_{down}$ is smaller than $P_{up}$, which is a power underbalance state, so that the power balance degree H2 reaches A22≤H2;

moving the movable counterweight box rightward by the driving device after the N strokes, if all the N H2s are smaller than A21 and $P_{down}$ is greater than $P_{up}$, which is a power overbalance state, so that the power balance degree H2 reaches A22≤H2.

In the above, a frequency converter is mounted between the main motor and the power supply input end; a load sensor is fixedly mounted on the beam hanger for collecting a load value F of a suspension center; a stroke process measurer is mounted on the digitized balance-shifting pumpjack for collecting a displacement value S of the suspension center; during each stroke, the central processor analyzes and calculates a ground dynamometer card based on the collected load value F of the suspension center and displacement value S of the suspension center, so as to obtain a ground dynamometer card, and the ordinate thereof is the coordinate of the load value F of the suspension center during oil-pumping by a polish rod, and the abscissa of the ground dynamometer card is the coordinate of the displacement value S of the suspension center during the oil-pumping by the polish rod. The central processor collects a stroke value S1 of the up stroke pump and an effective stroke value S2 of the down stroke pump based on the ground dynamometer card, then calculates a pump fullness H3, i.e., H3=S2/S1, compares the N pump fullness values H3s which are obtained according to the set stroke times N; a set value for a lower limit of the pump fullness value is A31, and a set value for a lower limit of pump fullness adjustment target is A32, and a set value for an upper limit of pump fullness is B31;

performing no adjustment on the frequency of stroke during the N strokes, as long as there is one value H3 in line with A31≤H3≤B31, which is an appropriate state of the frequency of stroke;

reducing a rotate speed of the main motor by a frequency converter to reduce the frequency of stroke after the N strokes, if all the N H3s are smaller than A31, which is an over higher state of the frequency of stroke, so that the pump fullness value H3 reaches A32≤H3≤B31;

increasing the rotate speed of the main motor by the frequency converter to increase the frequency of stroke after the N strokes, if all the N H3s are greater than A31, which is an over lower state of frequency of stroke, so that the pump fullness value H3 reaches A32≤H3≤B31.

In the above, A11 has a value of 0.8 to 0.85; A12 has a value of 0.9 to 0.95; B11 has a value of 1.10 to 1.15; B12 has a value of 1.0 to 1.05; or/and A21 has a value of 0.5 to 0.6, A22 has a value of 0.80 to 0.90; or/and A31 has a value of 0.5 to 0.6, A32 has a value of 0.75 to 0.85; B31 has a value of 0.85 to 0.95.

In the above, the set frequency of stroke of N is a set number; or/and the stroke process measurer is an angular displacement sensor mounted on the walking beam or a proximity switch fixedly mounted on the crank or a detecting sensor for suspension center displacement mounted on the beam hanger; or/and the three-phase electric parameter collecting device is an electric parameter dynamic balance tester or a current transformer.

The second technical solution of the present invention is realized by a digitized balance-shifting pumpjack including a main motor, a decelerator, a crank, a connecting rod, a walking beam, a balance arm, a derrick, a horsehead, a substructure, a brake device, a beam hanger and a stroke process measurer; the main motor, the decelerator, the brake device and the derrick are fixedly mounted on the substructure; the walking beam which is capable of swinging up and down is hinged on the top end of the derrick via a walking beam bearing in the middle thereof; the crank is mounted on a power output shaft of the decelerator; a lower end of the connecting rod is hinged together on the crank; an upper end of the connecting rod is hinged on a left portion of the walking beam, and the horsehead is fixedly mounted on a right end of the walking beam; the beam hanger is mounted on the horsehead, and the balance arm is fixedly mounted on a left end of the walking beam; a movable counterweight box and a driving device enabling the movable counterweight box to move leftward and rightward are respectively mounted on the balance arm.

The further optimization or/and improvement to the above-mentioned second technical solution of the present invention is/are provided as follows:

the above driving device comprises a decelerator with a balance motor, a screw and a nut; the decelerator with the balance motor is fixedly mounted on the balance arm; a screw bearing seat is fixedly mounted on one end of the balance arm, while an auxiliary screw bearing seat is fixedly mounted on the other end of the balance arm, and the two ends of the screw are mounted within the screw bearing seat and the auxiliary screw bearing seat respectively; one end of the screw is fixedly mounted together with a power output end of the decelerator with the balance motor via a coupler; the nut is mounted on the screw; the movable counterweight box is saddle-shaped with a through groove in the middle thereof, and through the through groove of the movable counterweight box passes the screw; four fixed blocks are fixedly mounted on the movable counterweight box, and among the four blocks a cross-through groove is formed; the nut is mounted within the cross-through groove and can drift leftward, rightward, upward and downward; a cover plate capable of blocking the nut is fixedly mounted outside the fixed block; the balance arm is provided with a slideway thereon; a pulley is mounted in an inner side of the movable counterweight box and located on the slideway; or/and a safety stop device is mounted on the balance arm and the movable counterweight box, and the safety stop device includes an induction plate, a down stroke inductive switch and an up stroke inductive switch; or/and the stroke process measurer is an angular displacement sensor mounted on the walking beam or a proximity switch fixedly mounted on the crank or a detecting sensor for suspension center displacement mounted on the beam hanger; the movable counterweight box includes a movable box and an active counterweight block; a partition plate is fixed within the movable box and thus the movable box is divided into a fixed counterweight chamber and an active counterweight chamber; the fixed counterweight chamber is filled with a fixed counterweight object, while an active counterweight block is mounted in the active counterweight chamber, and an insurance lever capable of blocking the active counterweight block is mounted on the movable box.

The above beam hanger includes a beam hanger body, a load sensor and a suspension line; and a load sensor is mounted on the beam hanger body.

In the above, a digitized control box is fixedly mounted on the substructure; a central processor, a communication module, a power module, a display module, an electric quantity module, a three-phase electric parameter collecting device, a control panel, a start and stop control relay, a frequency converter, a main motor frequency conversion alternating current contactor, a main motor power frequency alternating current contactor, a motor comprehensive protector, a balance adjustment control relay, a balance motor alternating current contactor and a current transducer are fixedly mounted within the digitized control box; a signal output end of the load sensor is electrically connected to a first signal input end of the central processor through a load sensor cable and a lower connecting cable; a signal output end of the stroke process measurer is electrically connected to a second signal input end of the central processor through an active cable and the lower connecting cable; the current transducer is mounted on a power input line of the decelerator which has a balance motor; a signal output end of the current transducer and a third signal input end of the central processor are connected electrically through a wire; signal output ends of the down stroke inductive switch and the up stroke inductive switch are electrically connected with a fourth signal input end of the central processor through the upper connecting cable, the active cable and the lower connecting cable; the signal output ends of the down stroke inductive switch and the up stroke inductive switch are electrically connected with a signal input end of the balance adjustment control relay through the upper connecting cable, the active cable and the lower connecting cable; a first signal output end of the central processor is electrically connected with the signal input end of the balance adjustment control relay through a wire; a signal output end of the balance adjustment control relay is electrically connected with a signal input end of the balance motor alternating current contactor through a wire; an output end of the balance motor alternating current contactor is electrically connected with an input end of the balance motor through a wire; the output end of the balance motor alternating current contactor is electrically connected with a signal input end of the current transducer through a wire; a second signal input end of the central processor is electrically connected with a signal input end of the start and stop control relay through a wire; a signal output end of the start and stop control relay is electrically connected with a signal input end of the main motor power frequency alternating current contactor through a wire; an output end of the main motor power frequency alternating current contactor is electrically connected with an input end of the main motor through a wire; the signal output end of the start and stop control relay is electrically connected with a signal input end of the main motor frequency conversion alternating current contactor through a wire; and an output end of the main motor frequency conversion alternating current contactor is electrically connected with the input end of the main motor through a wire.

In the above, a square head or a hexagonal head is mounted in a left end of the power output shaft of the decelerator which has a balance motor, and a rocker support seat is fixedly mounted on the balance arm; or/and a belt pulley quick-change device is mounted on the substructure; a lower end of the belt pulley quick-change device is hinged on the substructure while the main motor is fixedly mounted on an upper end surface of the belt pulley quick-change device; a support rod is hinged on the derrick, and there is a hinged support for correspondingly connecting the support rod on the walking beam; or/and a buffer device is fixedly mounted in a left portion of the substructure; or/and the three-phase electric parameter collecting device is an electric parameter dynamic balance tester or a current transformer.

The structure of the present invention is reasonable and compact, and is easy to use. By means of the co-use of the main motor, the decelerator, the connecting rod, the walking beam, the derrick, the horsehead, the beam hanger, the load sensor, the angular displacement sensor, the safety stop device and the digitized control box. The movable counterweight box can move leftward and rightward on the balance arm. A movable counterweight box moves leftward and rightward on the balance arm, automatically balancing load at the suspension center in various operating conditions, and pumpjack's frequency of stroke is automatically adjusted according to variations in pump fullness. Features include safety and reliability, convenience of operation, enhanced oil well production, balance rates, energy conservation and consumption reduction.

Figure 1:
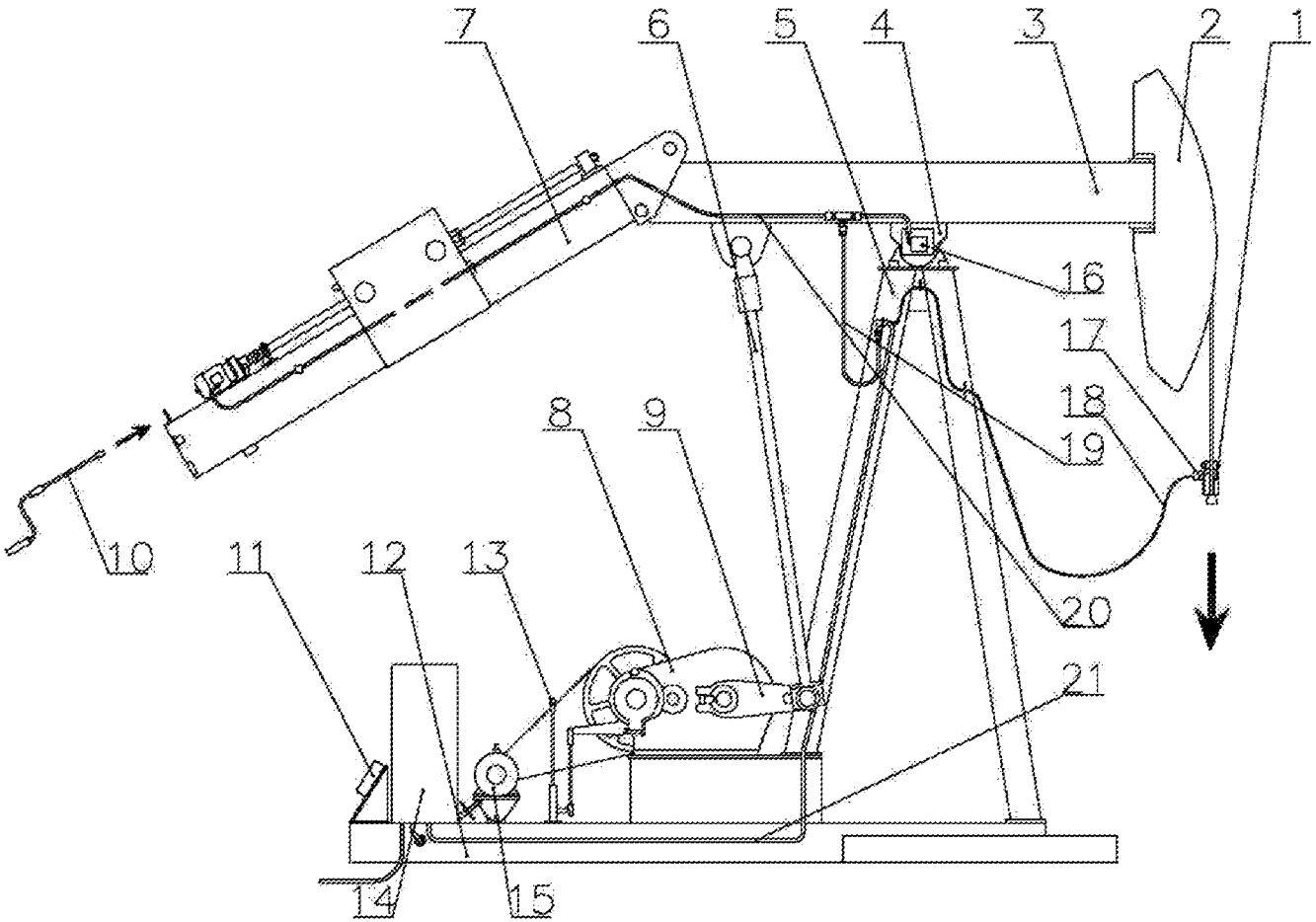
FIG. 1 is a structural schematic front view according to the second embodiment of the present invention.
Figure 2:
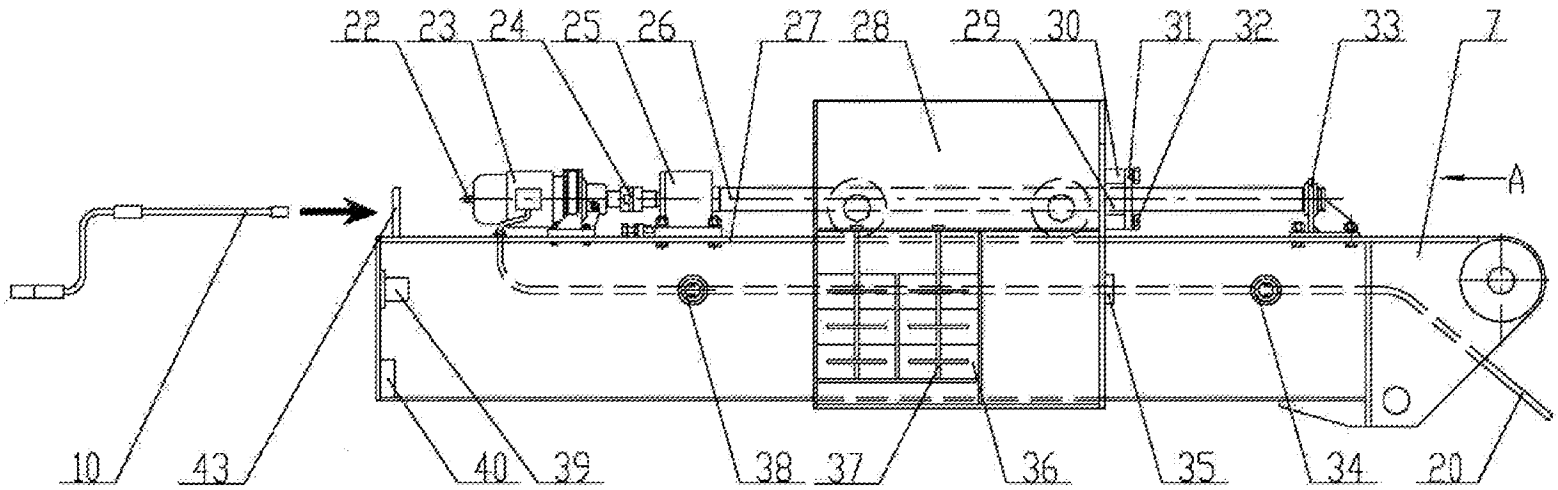
FIG. 2 is an enlarged structural schematic front view of the balance arm according to the second embodiment of the present invention.
Figure 3:
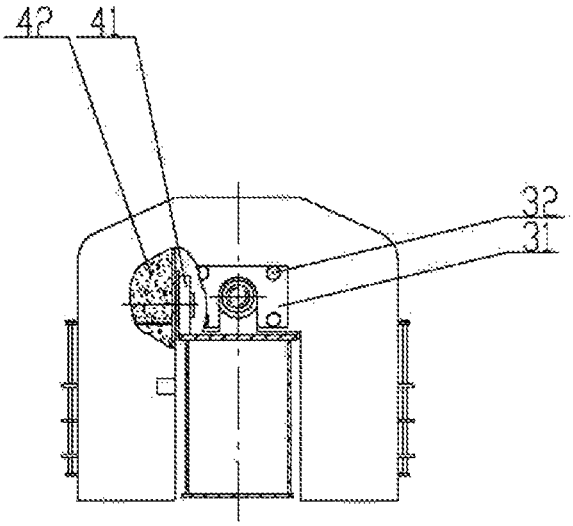
FIG. 3 is an enlarged A-direction structural schematic diagram of the movable counterweight box according to the second embodiment of the present invention.
Figure 4:
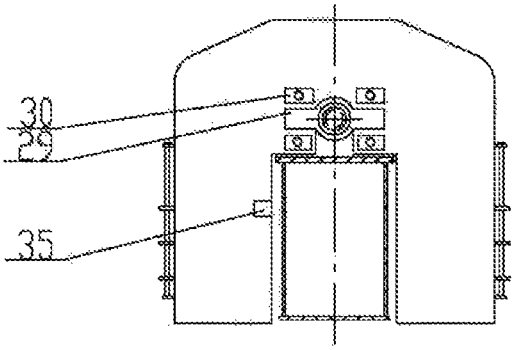
FIG. 4 is an enlarged A-direction structural schematic diagram of the movable counterweight box without any cover plates mounted thereon according to the second embodiment of the present invention.

The reference signs in the drawings are respectively as follows: 1. beam hanger; 2. horsehead; 3. walking beam; 4. walking beam bearing; 5. derrick; 6. connecting rod; 7. balance arm; 8. decelerator; 9. crank; 10. hand rocker; 11. buffer device; 12. substructure; 13. brake device; 14. digitized control box; 15. main motor; 16. angular displacement sensor; 17. load sensor; 18. load sensor cable; 19. active cable; 20. upper connecting cable; 21. lower connecting cable; 22. square head; 23. decelerator with a balance motor; 24. coupler; 25. screw bearing seat; 26. screw; 27. slideway; 28. movable counterweight box; 29. nut; 30. fixed block; 31. cover plate; 32. fastening bolts; 33. auxiliary screw bearing seat; 34. up stroke inductive switch; 35. induction plate; 36. active counterweight block; 37. insurance lever; 38. down stroke inductive switch; 39. movable box buffer block; 40. stopper; 41. pulley; 42. fixed counterweight object; and 43. rocker support seat.

DETAILED DESCRIPTION

The present invention is not limited to the embodiments below, and the specific embodiments may be determined according to the technical solutions of the present invention and the actual circumstances.

In the present invention, for the sake of description, the descriptions for the relative position relations of the components are in accordance with the layout of FIG. 1, e.g., the position relations of front, rear, upper, lower, left and right. are determined according to the direction of layout of FIG. 1.

Figure 9:
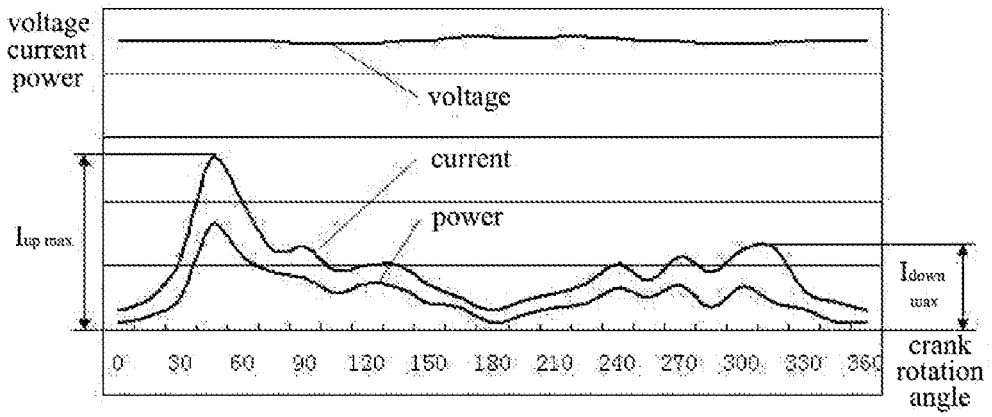
FIG. 9 is a curve diagram of the electric parameters in the cases of current underbalance state and power underbalance state according to the present invention.
Figure 10:
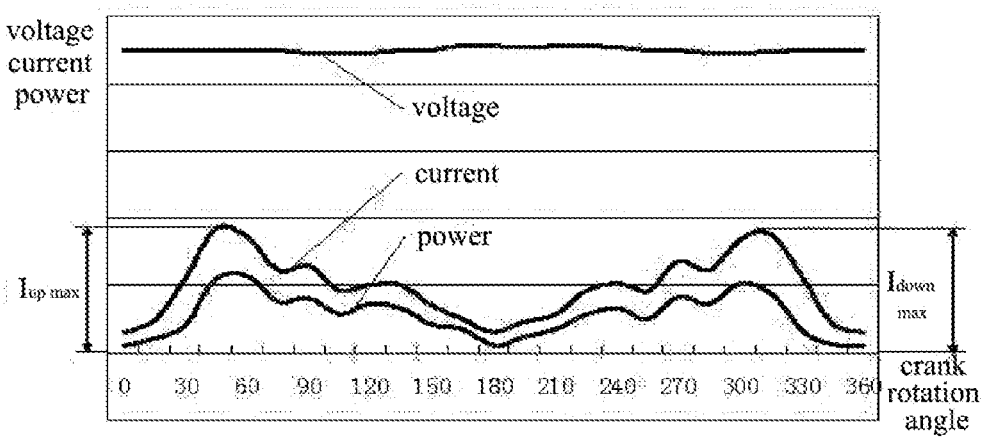
FIG. 10 is a curve diagram of the electric parameters in the cases of current balance state and the power balance state according to the present invention.
Figure 11:
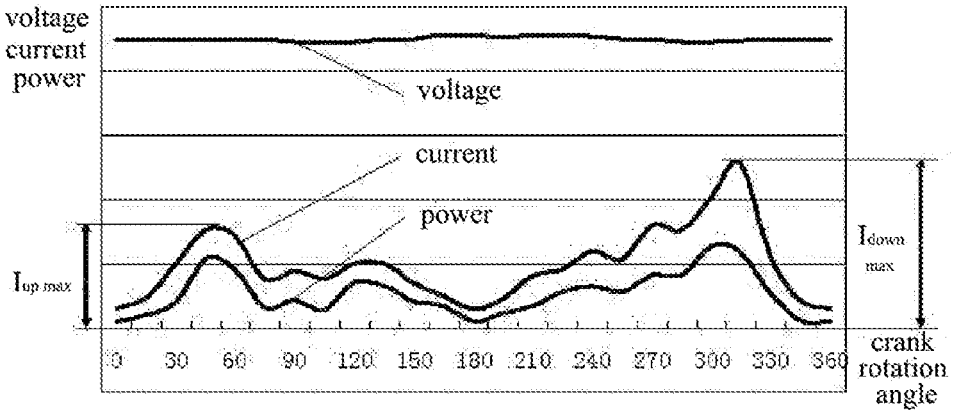
FIG. 11 is a curve diagram of the electric parameters in the cases of current overbalance state and power overbalance state according to the present invention.

The invention will now be further described with reference to the embodiments and the accompanying drawings:

Embodiment 1. As shown in FIGS. 9, 10 and 11, a digitized automatic control method for oil-pumping includes a digitized balance-shifting pumpjack. The pumpjack includes a main motor 15, a walking beam 3, a balance arm 7, a crank 9 and a beam hanger 1; the balance arm 7 is fixedly mounted on a left end of the walking beam 3; a movable counterweight box 28 and a driving device enabling the movable counterweight box 28 to move leftward and rightward are respectively mounted on the balance arm 7; a stroke process measurer is mounted on the digitized balance-shifting pumpjack; a load sensor 17 is fixedly mounted on the beam hanger 1; the pumpjack further includes a central processor and a three-phase electric parameter collecting device mounted on a power supply input end; and the method is performed in the following steps:

step 1: transmitting, respectively, data collected by a stroke process measurer and a three-phase electric parameter collecting device to a central processor; processing, by the central processor, a collected current value during each stroke process to find a maximum current value $I_{down\ max}$ in a down stroke and a maximum current value $I_{up\ max}$ in an up stroke; calculating, by the central processor, a current balance degree value H1, i.e., $H1=I_{down\ max}/I_{up\ max}$;

step 2: comparing N current balance degree values, H1 s, which are obtained according to set stroke times of N, with a set value for a lower limit of current balance degree being A11, a set value for a lower limit of a current balance degree adjustment target being A12, a set value for an upper limit of a current balance degree being B11, and a set value for an upper limit of a current balance degree adjustment target being B12;

performing no adjustment on the movable counterweight box 28 as long as there is one value H1 in line with A11≤H1≤B11 during the N strokes, which is a current balance state;

moving a movable counterweight box 28 leftward by a driving device after the N strokes, if all the N H1 s are smaller than A11, which is a current underbalance state so that the current balance degree H1 reaches A12≤H1≤B12;

moving the movable counterweight box 28 rightward by the driving device after the N strokes, if all the N H1 s are greater than B11, which is a current overbalance state so that the current balance degree H1 reaches A12≤H1≤B12.

The three-phase electric parameter collecting device collects the current and voltage in the stroke. After the collection, three kinds of state diagrams, which respectively are the curve diagram of the electric parameters in the cases of current underbalance state and power underbalance state as shown in FIG. 9, the curve diagram of the electric parameters in the cases of current balance state and power balance state as shown in FIG. 10, and the curve diagram of the electric parameters in the cases of current overbalance state and power overbalance state as shown in FIG. 11, are obtained.

A further optimization or/and improvement is/are made to the above-mentioned embodiment 1 according to actual needs:

As shown in FIGS. 9, 10 and 11, during each stroke, calculating, by the central processor, based on the collected current value and voltage value to obtain an average power value $P_{down}$ in the down stroke and an average power value $P_{up}$ in the up stroke, and comparing them. Taking the larger value as a denominator, i.e., $P_{large}$, and the smaller value as a numerator, i.e., $P_{small}$, and then calculating a power balance degree value H2, i.e., $H2=P_{small}/P_{large}$; comparing N power balance degree values, H2s, which are obtained according to the set stroke times N; the set value for a lower limit of power balance degree is A21, and the set value for a lower limit of power balance degree adjustment target is A22;

performing no adjustment on the movable counterweight box 28 during the N strokes, as long as there is one value H2 in line with A21≤H2, which is a power balance state;

moving the movable counterweight box 28 leftward by the driving device after the N strokes, if all the N H2s are smaller than A21 and $P_{down}$ is smaller than $P_{up}$, which is a power underbalance state, so that the power balance degree H2 reaches A22≤H2;

moving the movable counterweight box 28 rightward by the driving device after the N strokes, if all the N H2s are smaller than A21 and $P_{down}$ is greater than $P_{up}$, which is a power overbalance state, so that the power balance degree H2 reaches A22≤H2.

The three-phase electric parameter collecting device collects the current and voltage in the stroke, after the collection, three kinds of state diagrams, which respectively are the curve diagram of the electric parameters in the cases of current underbalance state and power underbalance state as shown in FIG. 9, the curve diagram of the electric parameters in the cases of current balance state and power balance state as shown in FIG. 10, and the curve diagram of the electric parameters in the cases of current overbalance state and power overbalance state as shown in FIG. 11, are obtained.

Figure 6:
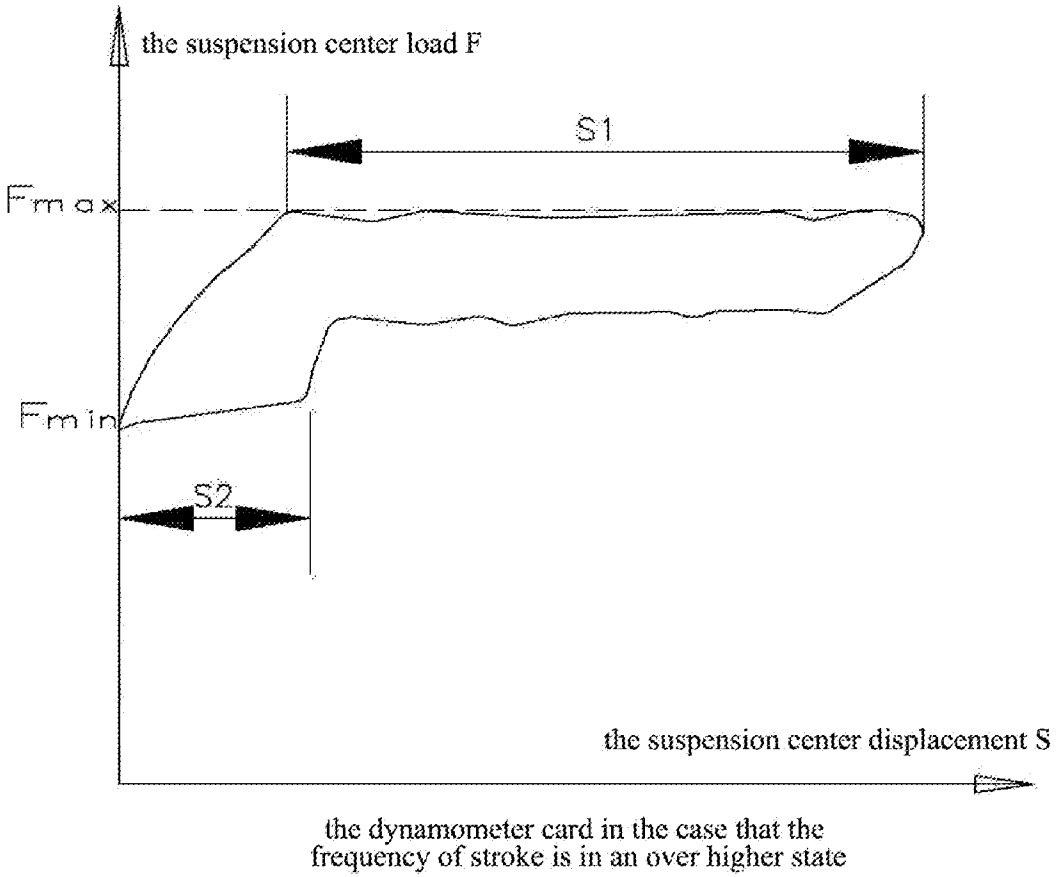
FIG. 6 is a dynamometer card in the case that the frequency of stroke is in an over higher state according to the present invention.
Figure 7:
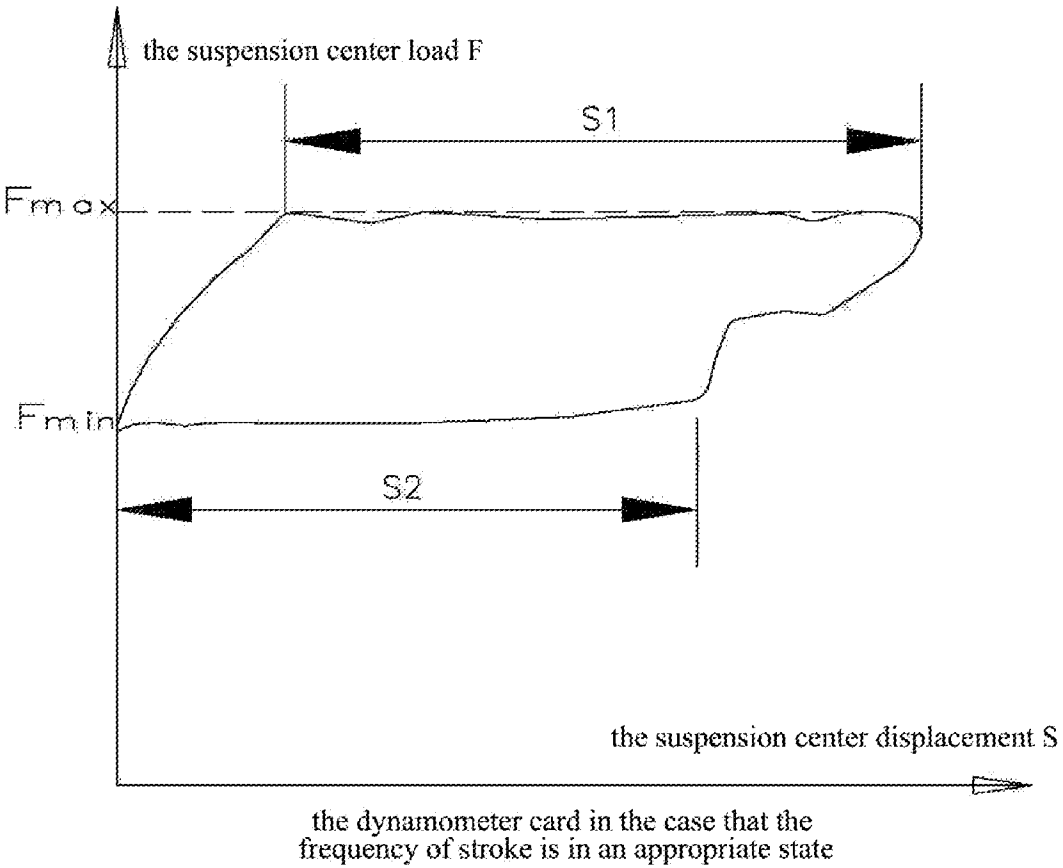
FIG. 7 is an dynamometer card in the case that the frequency of stroke is in an appropriate state according to the present invention.
Figure 8:
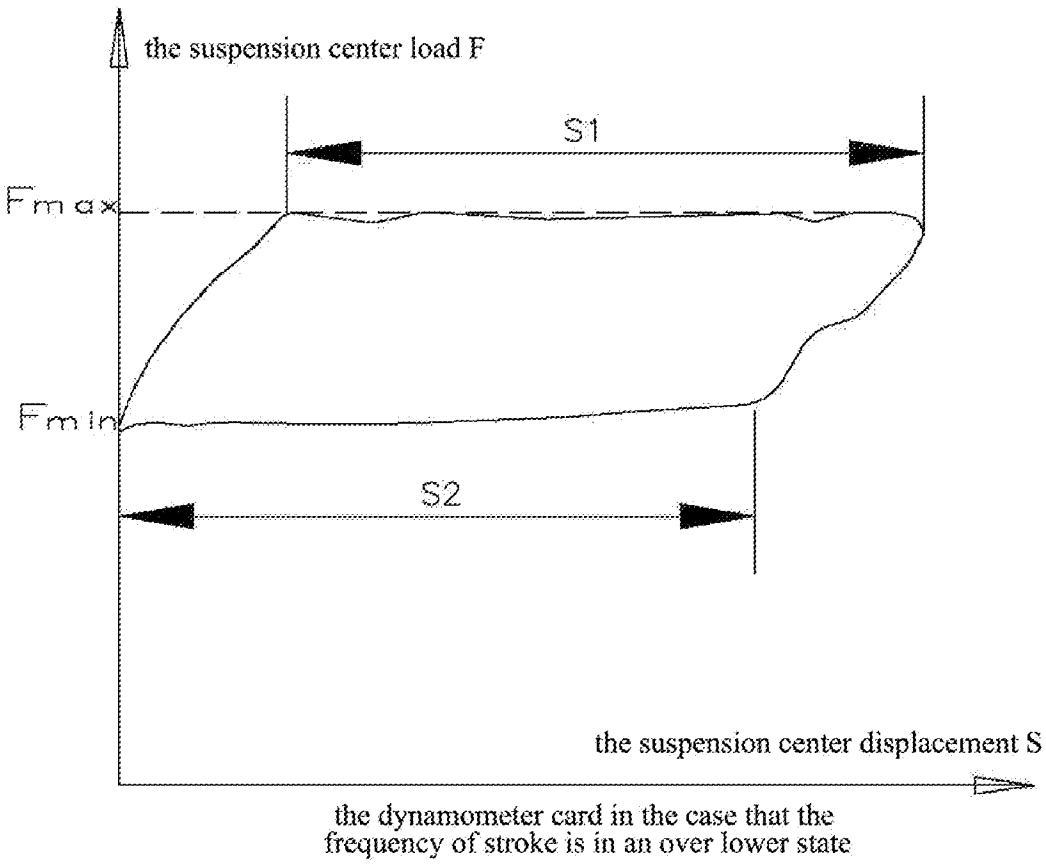
FIG. 8 is an dynamometer card in the case that the frequency of stroke is in an over lower state according to the present invention.

As shown in FIGS. 6 and 7 and 8, a frequency converter is mounted between the main motor 15 and the power supply input end; a load sensor 17 is fixedly mounted on the beam hanger for collecting a load value F of a suspension center; a stroke process measurer is mounted on the digitized balance-shifting pumpjack for collecting a displacement value S of the suspension center; during each stroke, the central processor analyzes and calculates a ground dynamometer card based on the collected load value F of the suspension center and displacement value S of the suspension center, so as to obtain a ground dynamometer card, and the ordinate thereof is the coordinate of the load value F of a suspension center during oil-pumping by a polish rod, and the abscissa of the ground dynamometer card is the coordinate of the displacement value S of the suspension center during the oil-pumping by the polish rod. The central processor collects a stroke value S1 of the up stroke pump and an effective stroke value S2 of the down stroke pump based on the ground dynamometer card, then calculates a pump fullness H3, i.e., 3=S2/S1, compares the N pump fullness values H3s which are obtained according to the set stroke times N; a set value for a lower limit of the pump fullness value is A31, and a set value for a lower limit of pump fullness adjustment target is A32, and a set value for an upper limit of pump fullness is B31;

performing no adjustment on the frequency of stroke during the N strokes, as long as there is one value H3 in line with A31≤H3≤B31, which is an appropriate state of the frequency of stroke;

reducing a rotate speed of the main motor 15 by a frequency converter to reduce the frequency of stroke after the N strokes, if all the N H3s are smaller than A31, which is an over higher state of the frequency of stroke, so that the pump fullness value H3 reaches A32≤H3≤B31;

increasing the rotate speed of the main motor 15 by the frequency converter to increase the frequency of stroke after the N strokes, if all the N H3s are greater than A31, which is an over lower state of the frequency of stroke, so that the pump fullness value H3 reaches A32 ≤H3≤B31.

By collecting the suspension center displacement during the stroke by the stroke process measurer, collecting suspension center load during the stroke by the load sensor and processing the above collected data by the central processor, three kinds of state diagrams, which respectively are the dynamometer card of the frequency of the stroke in over higher state as shown in FIG. 6, the dynamometer card of the frequency of the stroke in appropriate state as shown in FIG. 7 and the dynamometer card of the frequency of the stroke in over lower state as shown in FIG. 8, are obtained.

As needed, A11 has a value of 0.8 to 0.85; A12 has a value of 0.9 to 0.95; B11 has a value of 1.10 to 1.15; B12 has a value of 1.0 to 1.05; or/and A21 has a value of 0.5 to 0.6, A22 has a value of 0.80 to 0.90; or/and A31 has a value of 0.5 to 0.6, A32 has a value of 0.75 to 0.85; B31 has a value of 0.85 to 0.95.

$I_{up\ max}$ is the maximum current value of the main motor 15 in the up stroke; $I_{down\ max}$ is the maximum current value of the main motor 15 in the down stroke; $P_{up}$ is the average power value in the up stroke; $P_{down}$ is the average power value in the down stroke;

the electric parameter dynamic balance tester transmits the data to the central processor to obtain the current balance degree H1 and the power balance degree H2.

The calculation and analysis of the pump fullness H3 require the use of the stroke value S1 of the up stroke pump and the effective stroke value S2 of the down stroke pump, and the exact values of S1 and S2 should be obtained from the pump dynamometer card. The pump is mounted at the lower end of the oil tube, which is usually in the position with a depth of hundreds or even thousands of meters from the ground in production practice, thus it is difficult to obtain the pump dynamometer card directly, and therefore, the approximate values of S1 and S2 are generally obtained by using the ground dynamometer card. The ground dynamometer card is a closed curve consisting of the suspension center displacement S and the corresponding suspension center load F in a pumping period (including a complete up stroke and down stroke), where the abscissa is the suspension center displacement S and the ordinate is the suspension center load F. The stroke process measurer and the load sensor convert respectively the directly measured suspension center displacement S and analog electrical energy of the suspension center load F into digital electric energy via a conversion module in the central processor. The central processor collects the suspension center displacement S and the digital electric energy of the corresponding suspension center load F simultaneously at equal time intervals to form a series of point data, while the software logic identifies all the point data of S and F in a complete pumping period, which are then processed by the graphics software to obtain the ground dynamometer card. As shown in FIGS. 6, 7 and 8, the approximation value of the pump stroke S1 in the up stroke and the approximate value of the effective pump stroke S2 in the down stroke can be calculated by scanning and searching the point data in the dynamometer card.

As needed, the set frequency of stroke of N is a set number; or/and the stroke process measurer is an angular displacement sensor 16 mounted on the walking beam 3 or a proximity switch fixedly mounted on the crank 9 or a detecting sensor for suspension center displacement mounted on the beam hanger 1; or/and the three-phase electric parameter collecting device is an electric parameter dynamic balance tester or a current transformer.

Embodiment 2. As shown in FIGS. 1, 2, 3 and 4, a digitized balance-shifting pumpjack comprises a main motor 15, a decelerator 8, a crank 9, a connecting rod 6, a walking beam 3, a balance arm 7, a derrick 5, a horsehead 2, a substructure 12, a brake device 13, a beam hanger 1 and a stroke process measurer; the main motor 15, the decelerator 8, the brake device 13 and the derrick 5 are fixedly mounted on the substructure 12; the walking beam 3 capable of swinging up and down is hinged on the top end of the derrick 5 via a walking beam bearing 4 in the middle thereof; the crank 9 is mounted on a power output shaft of the decelerator 8; a lower end of the connecting rod 6 is hinged with the crank 9, while an upper end of the connecting rod 6 is fixedly hinged on a left portion of the walking beam 3, and a right end of the walking beam 3 is fixed with the horsehead 2; the beam hanger 1 is mounted on the horsehead 2; and the balance arm 7 is fixedly mounted on a left end of the walking beam 3, and a movable counterweight box 28 and a driving device enabling the movable counterweight box 28 to move leftward and rightward are respectively mounted on the balance arm 7.

A further optimization or/and improvement can be made to the above-mentioned embodiment 2 according to actual needs:

as shown in FIGS. 1, 2, 3 and 4, the driving device comprises a decelerator 23 with a balance motor, a screw 26 and a nut 29; the decelerator 23 with the balance motor is fixedly mounted on the balance arm 7; a screw bearing seat 25 is fixedly mounted on one end of the balance arm 7, while an auxiliary screw bearing seat 33 is fixedly mounted on the other end of the balance arm 7, and the two ends of the screw 26 are mounted within the screw bearing seat 25 and the auxiliary screw bearing seat 33 respectively; one end of the screw 26 is fixedly mounted together with a power output end of the decelerator 23 with the balance motor via a coupler 24; the nut 29 is mounted on the screw 26; the movable counterweight box 28 is saddle-shaped with a through groove in the middle thereof, and through the through groove of the movable counterweight box 28 passes the screw 26; four fixed blocks 30 are fixedly mounted on the movable counterweight box 28, and among the four blocks 30 a cross-through groove is formed; the nut 29 is mounted within the cross-through groove and can drift leftward, rightward, upward and downward; a cover plate 31 capable of blocking the nut is fixedly mounted outside the fixed block 30; the balance arm 7 is provided with a slideway 27 thereon; a pulley 41 is mounted in an inner side of the movable counterweight box 28 and located on the slideway 27; or/and a safety stop device is mounted on the balance arm 7 and the movable counterweight box 28, and the safety stop device includes an induction plate 35, a down stroke inductive switch 38 and an up stroke inductive switch 34; or/and the stroke process measurer is an angular displacement sensor 16 mounted on the walking beam 3 or a proximity switch fixedly mounted on the crank 9 or a detecting sensor for suspension center displacement mounted on the beam hanger 1; the movable counterweight box 28 includes a movable box and an active counterweight block 36; a partition plate is fixed within the movable box and thus the movable box is divided into a fixed counterweight chamber and an active counterweight chamber; the fixed counterweight chamber is filled with a fixed counterweight object 42, while an active counterweight block 36 is mounted in the active counterweight chamber, and an insurance lever 37 capable of blocking the active counterweight block 36 is mounted on the movable box. A movable box buffer block 39 is fixedly mounted on the left end of the balance arm 7, and a stopper 40 is fixedly mounted on the left end of the balance arm 7. As such, by means of the forward or reverse rotation of the decelerator 23 which has a balance motor, the coupler 24 drives the screw 26 to rotate, and the nut 26 drives the movable counterweight box 28 to move leftward and rightward on the balance arm 7, so that the variation in the suspension center load during the pumping is balanced. Four pulleys 41 are mounted on an inner side of the movable counterweight box 28 to better perform the supporting and guiding functions. When the movable counterweight box 28 arrives at either end of the balance arm 7 and thus the induction plate 35 on the counterweight box is close to the up stroke inductive switch 34 or the down stroke inductive switch 38, the induction plate 35 sends a stop signal to the down stroke inductive switch and the up stroke inductive switch. The central processor, the balance adjustment control relay and the balance motor alternating current contactor control the decelerator 23 which has the balance motor to stop its operation, and thus the movable weight box 28 stops moving; the up stroke inductive switch 34 and the down stroke inductive switch 38 cooperate with the sensing plate 35 for the position limitation protection of the left and right strokes of the moving weight box 28; the crank 9 is provided with three crank pin holes for adjusting the stroke. A cover plate 31 capable of blocking the nut 29 is fixedly mounted on the outer end of the fixed block 30 via a fastening bolt 32. The fixed counterweight object 42 may employ a well known material such as composite material coagulation to perform the function of reducing the manufacturing cost while meeting the counterweight requirement. The insurance lever 37 performs the function of protecting the active counterweight block 36 to prevent the active counterweight block 36 from falling down during operation; the balance is roughly adjusted by adjusting the number of the active counterweight block 36 within the active counterweight chamber of the movable box; the balance is accurately adjusted by changing the position of the movable counterweight box 28; and by combining both the adjustment of the number of the active counterweight blocks 36 and variation in the position of the movable counterweight box 28, it is easy for the digitized balance-shifting pumpjack to reach a balance and maintain the same.

As shown in FIG. 1, the beam hanger 1 includes a beam hanger body, a load sensor 17 and a suspension line; and the load sensor 17 is mounted on the beam hanger body.

Figure 5:
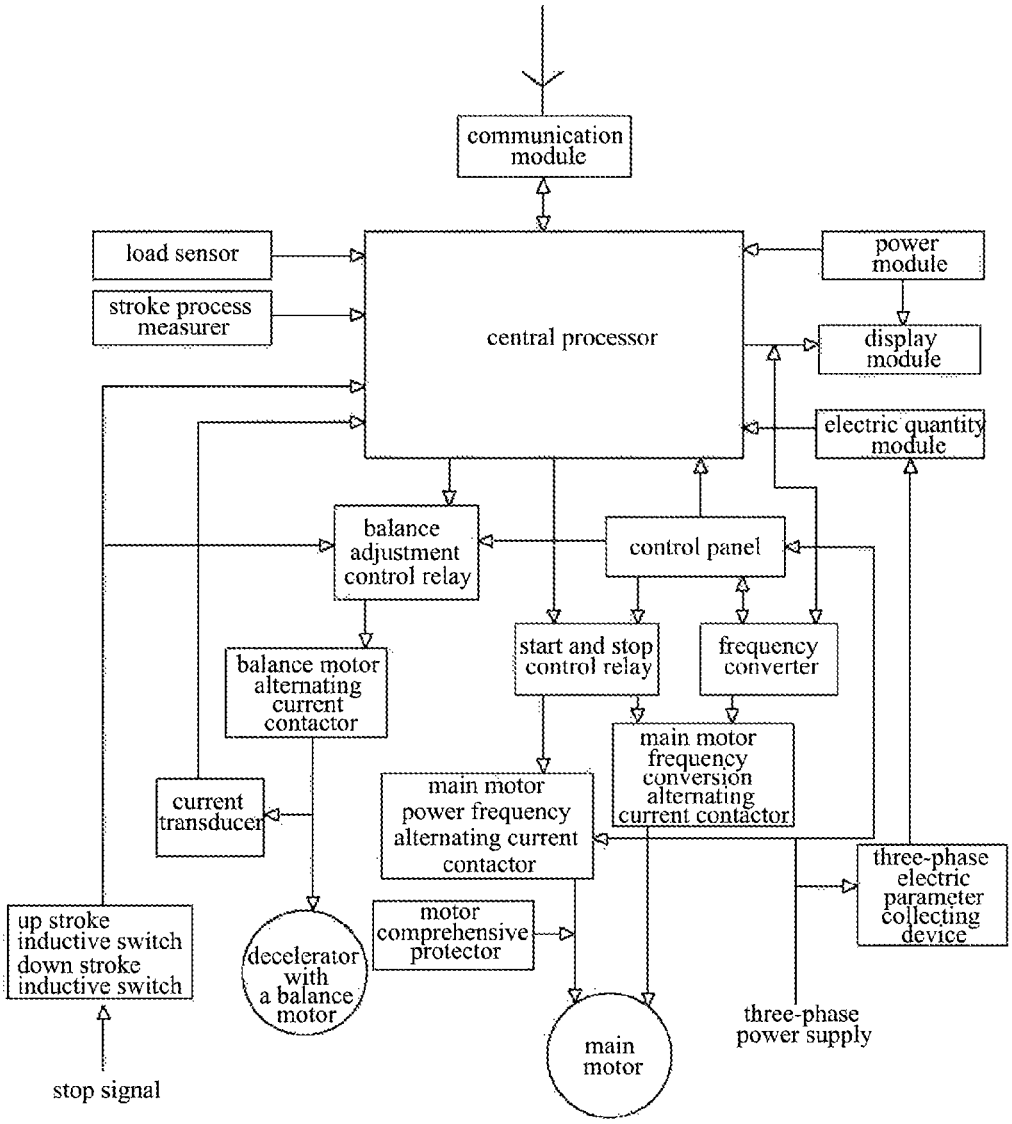
FIG. 5 is a schematic diagram of circuit control according the second embodiment of the present invention.

As shown in FIGS. 1 and 5, a digitized control box 14 is fixedly mounted on the substructure 12; a central processor, a communication module, a power module, a display module, an electric quantity module, a three-phase electric parameter collecting device, a control panel, a start and stop control relay, a frequency converter, a main motor frequency conversion alternating current contactor, a main motor power frequency alternating current contactor, a motor comprehensive protector, a balance adjustment control relay, a balance motor alternating current contactor and a current transducer are fixedly mounted within the digitized control box; a signal output end of the load sensor 17 is electrically connected to a first signal input end of the central processor through a load sensor cable 18 and a lower connecting cable 21; a signal output end of the stroke process measurer is electrically connected to a second signal input end of the central processor through an active cable 19 and the lower connecting cable 21; the current transducer is mounted on a power input line of the decelerator 23 which has a balance motor; a signal output end of the current transducer and a third signal input end of the central processor are connected electrically through a wire; signal output ends of the down stroke inductive switch and the up stroke inductive switch are electrically connected with a fourth signal input end of the central processor through the upper connecting cable 20, the active cable 19 and the lower connecting cable 21; the signal output ends of the down stroke inductive switch and the up stroke inductive switch are electrically connected with a signal input end of the balance adjustment control relay through the upper connecting cable 20, the active cable 19 and the lower connecting cable 21; a first signal output end of the central processor is electrically connected with the signal input end of the balance adjustment control relay through a wire; a signal output end of the balance adjustment control relay is electrically connected with a signal input end of the balance motor alternating current contactor through a wire; an output end of the balance motor alternating current contactor is electrically connected with an input end of the balance motor through a wire; the output end of the balance motor alternating current contactor is electrically connected with a signal input end of the current transducer through a wire; a second signal input end of the central processor is electrically connected with a signal input end of the start and stop control relay through a wire; a signal output end of the start and stop control relay is electrically connected with a signal input end of the main motor power frequency alternating current contactor through a wire; an output end of the main motor power frequency alternating current contactor is electrically connected with an input end of the main motor 15 through a wire; the signal output end of the start and stop control relay is electrically connected with a signal input end of the main motor frequency conversion alternating current contactor through a wire; and an output end of the main motor frequency conversion alternating current contactor is electrically connected with the input end of the main motor 15 through a wire.

As needed, a square head 22 or a hexagonal head is mounted in a left end of the power output shaft of the decelerator 23 which has a balance motor, and a rocker support seat 43 is fixedly mounted on the balance arm 7; or/and a belt pulley quick-change device is mounted on the substructure 12; a lower end of the belt pulley quick-change device is hinged on the substructure 12 while the main motor 15 is fixedly mounted on an upper end surface of the belt pulley quick-change device; a support rod is hinged on the derrick 5, and there is a hinged support for correspondingly connecting the support rod on the walking beam 3; or/and a buffer device 11 is fixedly mounted in a left portion of the substructure 12; or/and the three-phase electric parameter collecting device is an electric parameter dynamic balance tester or a current transformer. As such, when power is off or the decelerator 23 with the balance motor is damaged or the power supply cable is damaged or the balance is adjusted via hand-cranking or maintenance work is carried out, the hand rocker 10 or wrench can be used to manually rotate the square head 22 or the hexagonal head, so that the decelerator 23 with the balance motor rotates forward or reversely, and the movable counterweight box 28 moves leftward and rightward on the balance arm 7 by means of the screw 26. After the suspension center load-missing occurs in the present invention, the buffer device 11 facilitates the left end of the balance arm 7 to impact the buffer device 11 to release the impact energy, so as to protect the components such as the decelerator 8 and the main motor 15 effectively. The load sensor 17, the angular displacement sensor 16 and the decelerator 23 with the balance motor are connected with the digitized control box 14 by a connector capable of quick connection through the load sensor cable 18, the active cable 19, an upper connecting cable 20 and a lower connecting cable 21, and in particular, the active cable 19 between the walking beam 3 and the derrick 5, the upper connecting cable 20 and the lower connecting cable 21 are connected together via a connector capable of quick connection, and the connector connecting the active cable 19 and the lower connecting cable 21 is upward, so that the bending damage to the connector is reduced, the service life of the active cable is extended, and the cable is easy to get replaced.

Beneficial Effects of the Present Invention:

1) The present invention employs a movable automatic balance-adjusting structure, the balance is roughly adjusted by adjusting the number of the active counterweight blocks 36 in the movable box and accurately adjusted by changing the position of the movable counterweight box 28, the combination of which enables the pumpjack to achieve a balance adjustment required by different suspension center loads in various operating conditions easier, greatly improves the balance rate in production practice, protects the pumpjack and reduces the production costs.

2) The movable counterweight box 28 can be moved by the hand rocker, and even if the decelerator 23 with the balance motor is damaged, the power supply circuit of the same is damaged and the communication is interrupted, the balance can still be adjusted by hand-cranking, so that the pumpjack can continue operation without any security risks or an impact on the production due to production halt.

3) The electric parameters, which include a phase voltage, a phase current, a frequency, positive active energy, negative active energy, etc., are automatically measured, and according to the current and electric power data, the current balance state of the pumpjack is calculated, then the balance is automatically adjusted. The combination of the current balance degree and the power balance degree not merely protects the pumpjack, but saves energy as well.

4) The dynamometer card is automatically tested, and according to the pump fullness, the frequency of stroke is automatically adjusted, which can improve the fullness and efficiency of the pump.

5) The buffer device 11 is fixedly mounted on the left portion of the substructure 12, and after a suspension center load-missing occurs, the left portion of the balance arm 7 impacts the buffer device 11 to release energy, so as to effectively protect the components such as decelerator and main motor 15, and solve the safety protection problem after a suspension center load-missing occurs in the walking beam balance of the pumpjack.

6) There are two operating modes, i.e., frequency conversion and power frequency. When the frequency conversion mode fails, the operating mode automatically switches to the power frequency mode.

7) Test data is displayed locally or transmitted to remote areas via a communication module, and introduced into the oil well production management system to facilitate the network management of the oil well to the pumpjack.

The above technical features with a strong adaptability and the best implementation effect constitute the optimum embodiment of the present invention, and the unnecessary technical features can be added or reduced according to the actual needs for different circumstances.

What is claimed is:

1. A digitized automatic control method for oil-pumping, comprising: a digitized balance-shifting pumpjack, wherein the digitized balance-shifting pumpjack comprises a main motor, a walking beam, a balance arm, a crank and a beam hanger; the balance arm is fixedly mounted on a first end of the walking beam; a movable counterweight box and a driving device connected to the movable counterweight box to drive the movable counterweight box to move towards and away from the walking beam are respectively mounted on the balance arm; a stroke process measurer is an angular displacement sensor mounted on the walking beam or a proximity switch fixedly mounted on the crank or a suspension center displacement detecting sensor mounted on the beam hanger, and a load sensor is fixedly mounted on the beam hanger; the digitized balance-shifting pumpjack further comprises a central processor and a three-phase electric parameter collecting device mounted on a power supply input end to collect current and voltage of the power supply input end; and wherein the method is performed in following steps:

step 1: transmitting, respectively, data collected by the stroke process measurer and the three-phase electric parameter collecting device to the central processor; processing, by the central processor, a collected current value during each down stroke and each up stroke to find a maximum current value $I_{down\ max}$ in down strokes and a maximum current value $I_{up\ max}$ in up strokes; calculating, by the central processor, a current balance degree value H1, H1$=_{Idown\ max}/I_{up\ max}$;

step 2: comparing N current balance degree values, H1s, which are obtained according to preset stroke times of N, with a preset value for a lower limit of current balance degree being A11, a preset value for a lower limit of a current balance degree adjustment target being A12, a preset value for an upper limit of a current balance degree being B11, and a preset value for an upper limit of a current balance degree adjustment target being B12, wherein N is an integer greater than or equal to 1;

during N strokes, as long as there is one value H1 that satisfies A11 ≤H1 ≤B11, which is a current balance state, performing no adjustment on the movable counterweight box;

after the N strokes, if all the N H1s are smaller than A11, which is a current underbalance state, moving the movable counterweight box away from the walking beam by the driving device to cause the current balance degree H1 to satisfy A12≤H1≤B12;

after the N strokes, if all the N H1s are greater than B11, which is a current overbalance state, moving the movable counterweight box towards the walking beam by the driving device to cause the current balance degree H1 to satisfy A12≤H1≤B12.

2. The digitized automatic control method for oil-pumping according to claim 1, wherein, during each stroke, performing, by the central processor, a calculation on the collected current value and a collected voltage value to obtain an average power value $P_{down}$ in the down strokes and an average power value Pup in the up strokes, and comparing, by the central processor, them; taking the larger value as a denominator, $P_{large}$, and the smaller value as a numerator, $P_{small}$, and then calculating a power balance degree value H2, H2 $=P_{small}/P_{large}$; comparing N power balance degree values, H2s, which are obtained according to preset stroke times N; a preset value for a lower limit of the power balance degree is A21, and a preset value for a lower limit of a power balance degree adjustment target is A22;

during the N strokes, as long as there is one value H2 that satisfies A21≤H2, which is a power balance state, performing no adjustment on the movable counterweight box during the N strokes;

after the N strokes, if all the N H2s are smaller than A21 and $P_{down}$ is smaller than $P_{up}$, which is a power underbalance state, moving the movable counterweight box away from the walking beam by the driving device to cause the power balance degree H2 to satisfy A22≤H2;

after the N strokes, if all the N H2s are smaller than A21 and $P_{down}$ is greater than $P_{up}$, which is a power overbalance state, moving the movable counterweight box towards the walking beam by the driving device to cause the power balance degree H2 to satisfy A22≤H2.

3. The digitized automatic control method for oil-pumping according to claim 2, wherein a frequency converter is mounted between the main motor and the power supply input end; the load sensor is fixedly mounted on the beam hanger for collecting a load value F of a suspension center; the stroke process measurer is mounted on the digitized balance-shifting pumpjack for collecting a displacement value S of the suspension center; during each stroke, the central processor analyzes and calculates the collected load value F of the suspension center and displacement value S of the suspension center, so as to obtain a ground dynamometer card, and an ordinate of the ground dynamometer card is a coordinate of the load value F of the suspension center during oil-pumping, and an abscissa of the ground dynamometer card is a coordinate of the displacement value S of the suspension center during the oil-pumping; the central processor collects a stroke value Si of an up stroke of the pump and an effective stroke value S2 of a down stroke of the pump based on the ground dynamometer card, then calculates a pump fullness H3, H3=S2/S1, compares the N pump fullness values H3s which are obtained according to the preset stroke times N; a preset value for a lower limit of the pump fullness value is A31, and a preset value for a lower limit of a pump fullness adjustment target is A32, and a preset value for an upper limit of pump fullness is B31;

during the N strokes, as long as there is one value H3 that satisfies A31≤H3≤B31, which is an appropriate state of the frequency of stroke, performing no adjustment on a frequency of stroke during the N strokes;

after the N strokes, if all the N H3s are smaller than A31, which is an over higher state of the frequency of stroke, reducing a rotate speed of the main motor by the frequency converter to reduce the frequency of stroke to cause the pump fullness value H3 to satisfy A32≤H3≤B31;

after the N strokes, if all the N H3s are greater than A31, which is an over lower state of the frequency of stroke, increasing the rotate speed of the main motor by the frequency converter to increase the frequency of stroke to cause the pump fullness value H3 to satisfy A32 ≤H3 ≤B31.

4. The digitized automatic control method for oil-pumping according to claim 3, wherein A11 has a value of 0.8 to 0.85; A12 has a value of 0.9 to 0.95; B11 has a value of 1.10 to 1.15; B12 has a value of 1.0 to 1.05; or/and A21 has a value of 0.5 to 0.6;

A22 has a value of 0.80 to 0.90; or/and A31 has a value of 0.5 to 0.6; A32 has a value of 0.75 to 0.85; B31 has a value of 0.85 to 0.95.

5. The digitized automatic control method for oil-pumping according to claim 3, wherein the preset stroke times of N is a preset number; and the three-phase electric parameter collecting device is a current transformer.

6. A digitized balance-shifting pumpjack for performing the digitized automatic control method for oil-pumping of claim 1, wherein the digitized balance-shifting pumpjack comprises the main motor, a decelerator, the crank, a connecting rod, the walking beam, the balance arm, a derrick, a horsehead, a substructure, a brake device, the beam hanger and the stroke process measurer; the main motor, the decelerator, the brake and the derrick are fixedly mounted on the substructure, the walking beam which is capable of swinging up and down is hinged on a top end of the derrick via a walking beam bearing in the middle thereof; the crank is mounted on a power output shaft of the decelerator; a lower end of the connecting rod is hinged together on the crank; an upper end of the connecting rod is hinged on a first portion of the walking beam, and the horsehead is fixedly mounted on a second end of the walking beam; the beam hanger is mounted on the horsehead, and the balance arm is fixedly mounted on a first end of the walking beam; a movable counterweight box and the driving device connected to the movable counterweight box to drive the movable counterweight box to move towards and away from the walking beam are respectively mounted on the balance arm.

7. The digitized balance-shifting pumpjack according to claim 6, wherein the driving device comprises the decelerator with a balance motor, a screw and a nut; the decelerator with the balance motor is fixedly mounted on the balance arm; a screw bearing seat is fixedly mounted on one end of the balance arm, while an auxiliary screw bearing seat is fixedly mounted on the other end of the balance arm, and the two ends of the screw are mounted within the screw bearing seat and the auxiliary screw bearing seat respectively; one end of the screw is fixedly mounted together with a power output end of the decelerator with the balance motor via a coupler; the nut is mounted on the screw; the movable counterweight box is saddle-shaped with a through groove in the middle thereof, and the screw passes through the through groove of the movable counterweight box; four fixed blocks are fixedly mounted on the movable counterweight box, and among the four blocks a cross-through groove is formed; the nut is mounted within the cross-through groove and can drift all around; a cover plate capable of blocking the nut is fixedly mounted outside the fixed blocks; the balance arm is provided with a slideway thereon; and a safety stop device is mounted on the balance arm and the movable counterweight box, and the safety stop device comprises an induction plate, a down stroke inductive switch and an up stroke inductive switch; and the stroke process measurer is the angular displacement sensor mounted on the walking beam or the proximity switch fixedly mounted on the crank or the suspension center displacement detecting sensor mounted on the beam hanger; the movable counterweight box includes a movable box and an active counterweight block; a partition plate is fixed within the movable box and thus the movable box is divided into a fixed counterweight chamber and an active counterweight chamber; the fixed counterweight chamber is filled with a fixed counterweight object, while an active counterweight block is mounted in the active counterweight chamber, and an insurance lever capable of blocking the active counterweight block is mounted on the movable box.

8. The digitized balance-shifting pumpjack according to claim 6, wherein the beam hanger comprises a beam hanger body, the load sensor and a suspension line; and the load sensor is mounted on the beam hanger body.

9. The digitized balance-shifting pumpjack according to claim 7, wherein a digitized control box is fixedly mounted on the substructure; the central processor, a communication module, a power module, a display module, an electric quantity module, the three-phase electric parameter collecting device, a control panel, a start and stop control relay, a frequency converter, a main motor frequency conversion alternating current contactor, a main motor power frequency alternating current contactor, a motor comprehensive protector, a balance adjustment control relay, a balance motor alternating current contactor and a current transducer are fixedly mounted within the digitized control box; a signal output end of the load sensor is electrically connected to a first signal input end of the central processor through a load sensor cable and a lower connecting cable; a signal output end of the stroke process measurer is electrically connected to a second signal input end of the central processor through an active cable and the lower connecting cable, wherein a first end of the load sensor cable is electrically connected to the signal output end of the load sensor, a first end of the active cable is electrically connected to the signal output end of the stroke process measurer, a first end of the lower connecting cable is electrically connected to the central processor, and a second end of the load sensor cable is electrically connected to a second end of the active cable and a second end of the lower connecting cable; the current transducer is mounted on a power input line of the decelerator with the balance motor; a signal output end of the current transducer and a third signal input end of the central processor are connected electrically through a wire; signal output ends of the down stroke inductive switch and the up stroke inductive switch are electrically connected with a fourth signal input end of the central processor through the upper connecting cable, the active cable and the lower connecting cable; the signal output ends of the down stroke inductive switch and the up stroke inductive switch are electrically connected with a signal input end of the balance adjustment control relay through the upper connecting cable, the active cable and the lower connecting cable; a first signal output end of the central processor is electrically connected with the signal input end of the balance adjustment control relay through a wire; a signal output end of the balance adjustment control relay is electrically connected with a signal input end of the balance motor alternating current contactor through a wire; an output end of the balance motor alternating current contactor is electrically connected with an input end of the balance motor through a wire; the output end of the balance motor alternating current contactor is electrically connected with a signal input end of the current transducer through a wire; the second signal output end of the central processor is electrically connected with a signal input end of the start and stop control relay through a wire; a signal output end of the start and stop control relay is electrically connected with a signal input end of the main motor power frequency alternating current contactor through a wire; an output end of the main motor power frequency alternating current contactor is electrically connected with an input end of the main motor through a wire; the signal output end of the start and stop control relay is electrically connected with a signal input end of the main motor frequency conversion alternating current contactor through a wire; and an output end of the main motor frequency conversion alternating current contactor is electrically connected with the input end of the main motor through a wire.

10. The digitized balance-shifting pumpjack according to claim 7, wherein a square head or a hexagonal head is mounted on an end of the power output shaft of the decelerator with the balance motor away from the screw, and a rocker support seat is fixedly mounted on the balance arm; a belt pulley quick-change device is mounted on the substructure; a lower end of the belt pulley quick-change device is hinged on the substructure while the main motor is fixedly mounted on an upper end surface of the belt pulley quick-change device; a support rod is hinged on the derrick, and there is a hinged support for correspondingly connecting the support rod on the walking beam; or/and a buffer device is fixedly mounted in a portion of the substructure near the balance arm; and the three-phase electric parameter collecting device is an electric parameter dynamic balance tester or a current transformer.

* * * * *